US010455903B2

(12) United States Patent
Nimura et al.

(10) Patent No.: US 10,455,903 B2
(45) Date of Patent: Oct. 29, 2019

(54) BUCKLE DEVICE

(71) Applicant: ASHIMORI INDUSTRY CO., LTD., Osaka-shi, Osaka (JP)

(72) Inventors: Yoichi Nimura, Settsu (JP); Hiroki Yamakawa, Settsu (JP); Shogo Akiyama, Settsu (JP)

(73) Assignee: ASHIMORI INDUSTRY CO., LTD., Osaka (JP)

( * ) Notice: Subject to any disclaimer, the term of this patent is extended or adjusted under 35 U.S.C. 154(b) by 0 days.

(21) Appl. No.: 15/984,745

(22) Filed: May 21, 2018

(65) Prior Publication Data

US 2018/0332930 A1 Nov. 22, 2018

(30) Foreign Application Priority Data

May 22, 2017 (JP) ..... 2017-100850

(51) Int. Cl.
*A44B 11/25* (2006.01)

(52) U.S. Cl.
CPC ..... *A44B 11/2523* (2013.01); *A44B 11/2546* (2013.01); *Y10T 24/45623* (2015.01); *Y10T 24/45665* (2015.01)

(58) Field of Classification Search
CPC ..... Y10T 24/45665; Y10T 24/45623; Y10T 24/4567; A44B 11/2546; A44B 11/2523
See application file for complete search history.

(56) References Cited

U.S. PATENT DOCUMENTS 4,885,825 A * 12/1989 Kitazawa ..... A44B 11/2523 24/639
5,357,658 A * 10/1994 Tanaka ..... A44B 11/2523 24/633
6,427,297 B1 8/2002 Yamaguchi et al.

FOREIGN PATENT DOCUMENTS

JP 3886087 B2 2/2007

* cited by examiner

*Primary Examiner* — Robert Sandy
*Assistant Examiner* — Michael S Lee
(74) *Attorney, Agent, or Firm* — Sughrue Mion, PLLC

(57) ABSTRACT

A buckle device including: a tongue plate; and a buckle main body configured to be engaged with the tongue plate, the buckle main body including: a cover having a tongue plate guide portion; a resin release button forming a tongue plate insertion port between the tongue plate guide portion and the release button; and a frame configured to slidably support the release button and having a bottom wall and a pair of side walls, wherein protruding portions protruding inward so as to overlap with the tongue plate inserted from the tongue plate insertion port are provided on end portions of the pair of side walls of the frame on the side of the tongue plate insertion port, respectively, and wherein the release button has a front wall and at least one extending portion extending from the front wall through a space between the protruding portions and the bottom wall.

6 Claims, 8 Drawing Sheets

BUCKLE DEVICE

CROSS-REFERENCE TO RELATED APPLICATIONS

This application claims priority from Japanese Patent Application No. 2017-100850 filed on May 22, 2017, the entire contents of which are incorporated herein by reference.

TECHNICAL FIELD

The disclosure relates to a buckle device which is a component of a seatbelt device of a vehicle.

BACKGROUND

There is known a buckle device which includes a tongue plate slidably provided along a longitudinal direction of a webbing and a buckle main body engaged with the tongue plate. The buckle main body includes a release button and a cover accommodating the release button. A part of the cover forms a tongue plate guide portion, and a tongue plate insertion port is formed between the tongue plate guide portion and the release button.

Further, a frame for slidably supporting the release button is disposed in the cover. The frame has a bottom wall forming a wall surface continuous with the tongue plate guide portion of the cover, and a pair of side walls standing from both end portions of the bottom wall. The frame has a U-shaped cross section.

Generally, a guide portion for guiding a tongue plate inserted from a tongue plate insertion port is provided in the vicinity of the tongue plate insertion port on a pair of side walls of a frame. However, when the tongue plate is inserted into the tongue plate insertion port in a state of being obliquely inclined, the tongue plate may get caught in the guide portion. In order to solve this problem, a buckle device 100 disclosed in JP-B-3886087 and shown in FIG. 8 is configured in such a manner that a release button (described as an operation button in JP-B-3886087) 110 is provided with a side wall 111 located inside of a guide portion 121 of a frame 120 and protruding downward from the guide portion 121.

However, in the configuration as shown in FIG. 8, the release button 110 is made of a resin. Therefore, when a tongue plate 130 is inserted into a tongue plate insertion port with a relatively large force in a state of being obliquely inclined, the side wall 111 may be bent and the tongue plate 130 may collide with the guide portion 121. The frame 120 including the guide portion 121 and an insertion portion (the portion inserted into the tongue plate insertion port) of the tongue plate 130 are made of a metal. Therefore, when the tongue plate 130 collides with the guide portion 121, there is a possibility that both are damaged.

SUMMARY

Accordingly, the disclosure aims to provide a buckle device capable of preventing the collision between a tongue plate and a frame when the tongue plate is inserted into a tongue plate insertion port in a state of being obliquely inclined.

An aspect of the present disclosure is a buckle device including: a tongue plate slidably provided along a longitudinal direction of a webbing; and a buckle main body configured to be engaged with the tongue plate, the buckle main body including: a cover having a tongue plate guide portion; a resin release button forming a tongue plate insertion port with the tongue plate guide portion; and a frame configured to slidably support the release button and having a bottom wall and a pair of side walls, wherein protruding portions protruding inward so as to overlap with the tongue plate inserted from the tongue plate insertion port are provided on end portions of the pair of side walls of the frame on the side of the tongue plate insertion port, respectively, and wherein the release button has a front wall and at least one extending portion extending from the front wall through a space between the protruding portions and the bottom wall.

DETAILED DESCRIPTION

Figure 1:
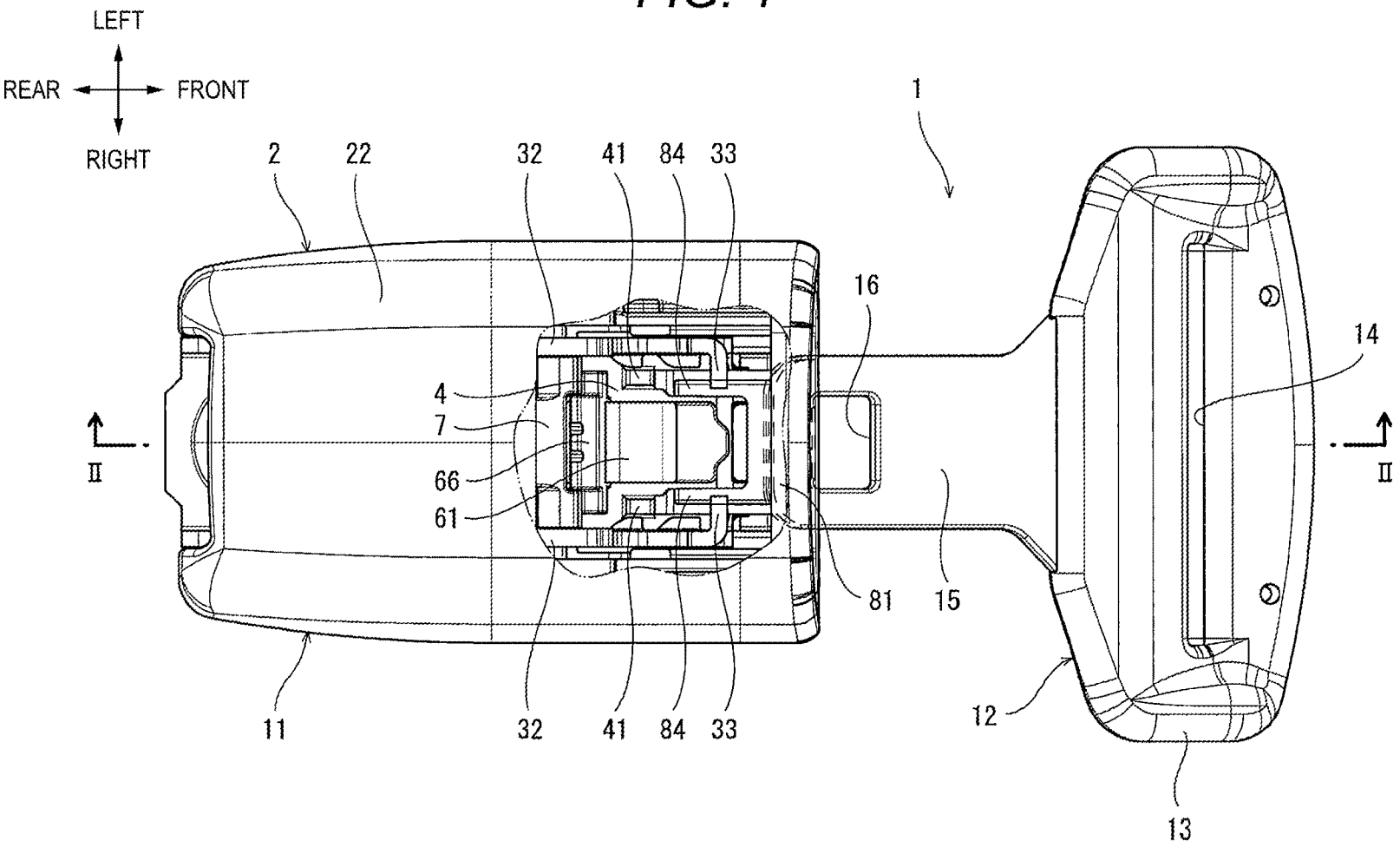
FIG. 1 is a plan view of a buckle device according to an embodiment of the disclosure.
Figure 2:
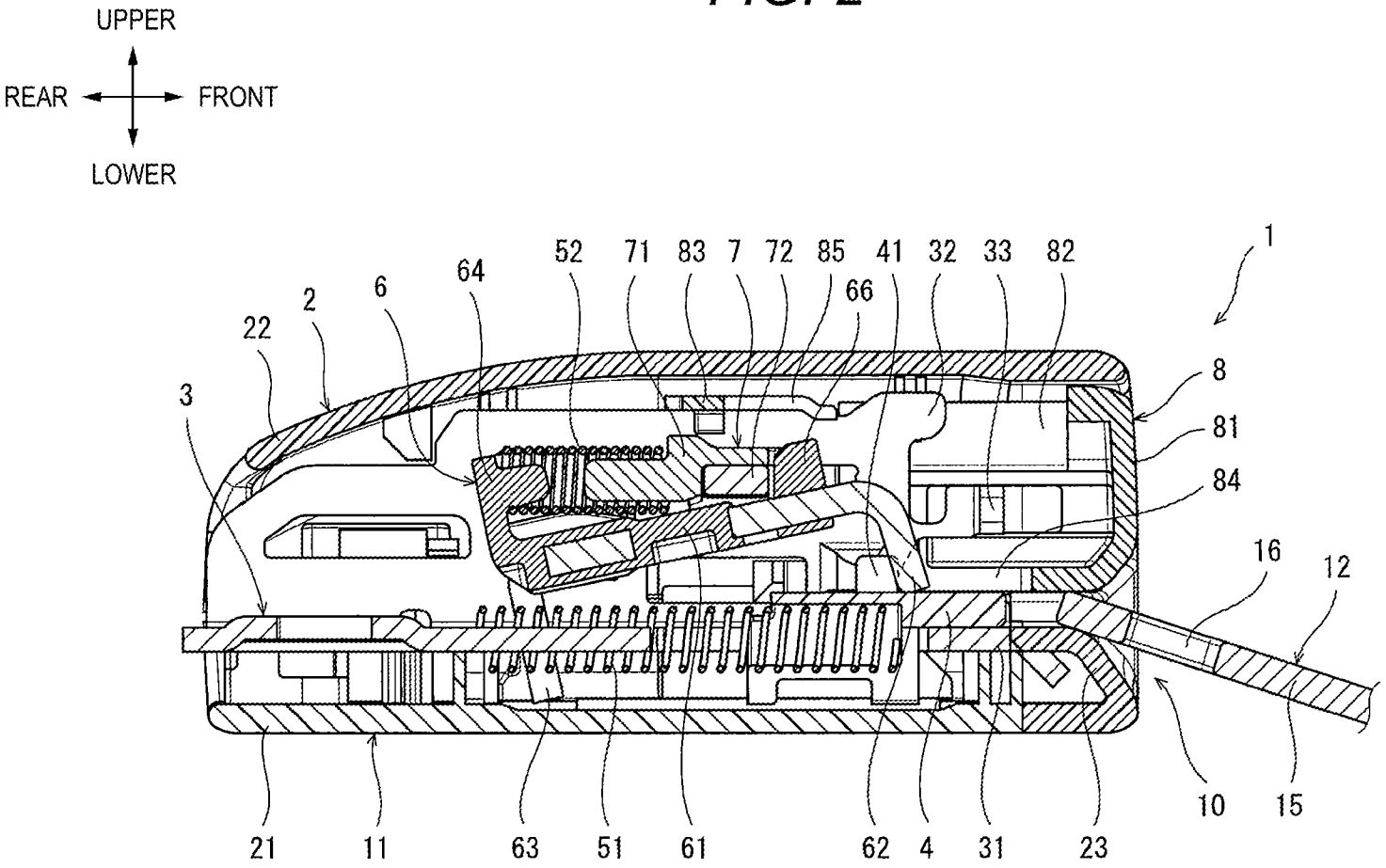
FIG. 2 is a sectional view taken along the line II-II in FIG. 1.

A buckle device 1 according to an embodiment of the disclosure is shown in FIGS. 1 and 2. The buckle device 1 is a component of a seatbelt device of a vehicle.

The buckle device 1 includes a tongue plate 12 slidably provided along a longitudinal direction of a webbing (not shown) that is a seatbelt, and a buckle main body 11 configured to be engaged with the tongue plate 12.

The tongue plate 12 includes a main body part 13 in which a webbing insertion hole 14 is formed, and an insertion part 15 protruding from the main body part 13. An engaging hole 16 is formed in the insertion part 15. The tongue plate 12 is made of a metal plate and a resin partially covering the metal plate. The insertion part 15 is made of only a metal plate.

The buckle main body 11 includes a release button 8 and a cover 2 for accommodating the release button 8. Both the release button 8 and the cover 2 are made of a resin. The cover 2 has a flat bottom surface and a substantially rectangular front opening which opens toward the front side (the right side in FIGS. 1 and 2). The portion of the cover 2 located below the front opening forms a tongue plate guide portion 23. A tongue plate insertion port 10 is formed between the tongue plate guide portion 23 and the release button 8.

Figure 3:
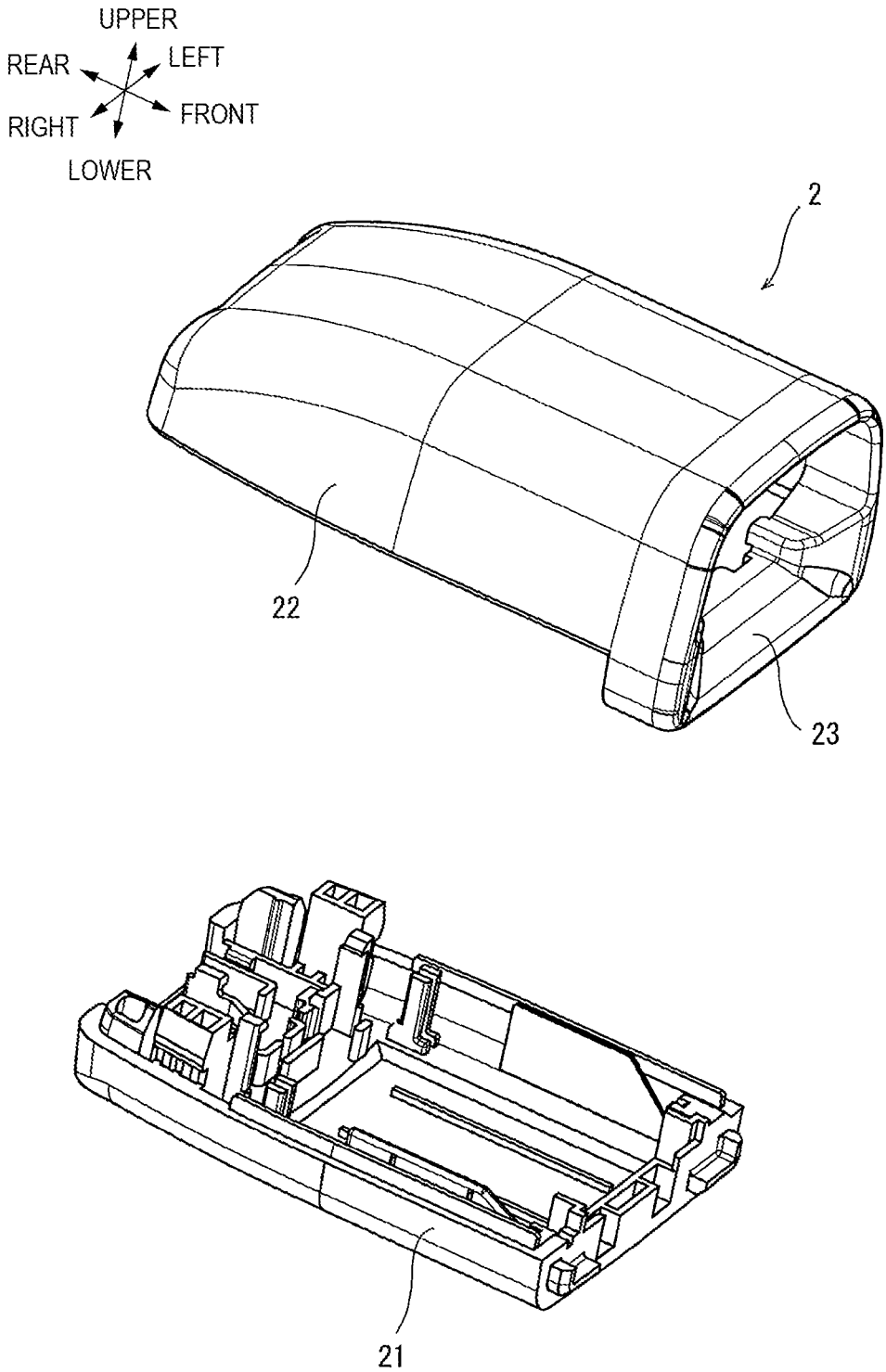
FIG. 3 is an exploded perspective view of a cover.

As shown in FIG. 3, in the present embodiment, the cover 2 is divided into a lower cover 21 and an upper cover 22. The tongue plate guide portion 23 is integrally formed on the upper cover 22. However, the tongue plate guide portion 23 may be integrally formed on the lower cover 21.

Figure 4:
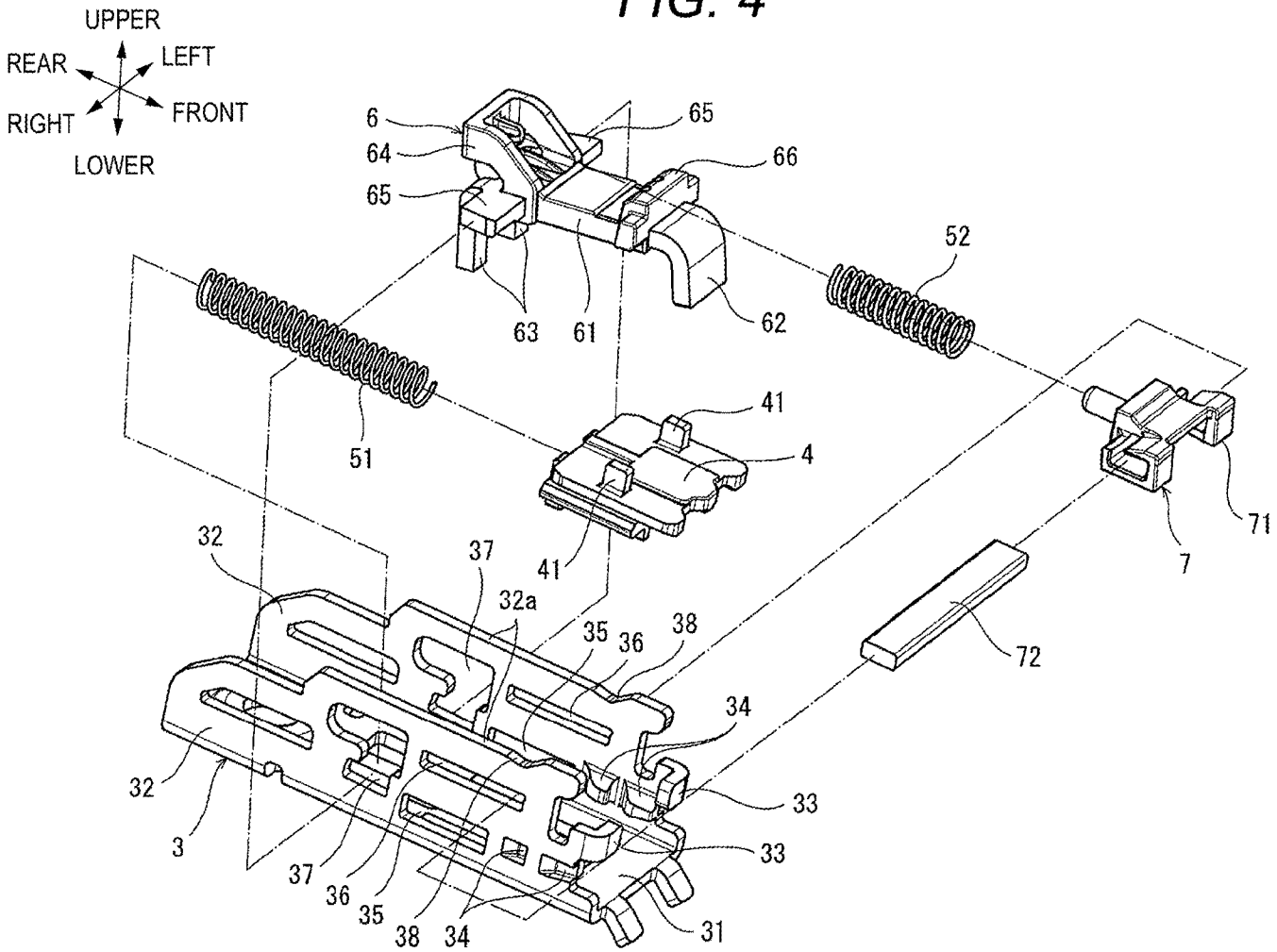
FIG. 4 is an exploded perspective view of a frame, an ejector, a hook member, and a lock bar.

As shown in FIG. 2, a frame 3, an ejector 4, a hook member 6, and a lock bar 7 are arranged in the cover 2 (see FIG. 4 for the shapes of these parts). The frame 3 slidably supports the release button 8. The ejector 4 is made of a resin and abuts against the tongue plate 12 inserted from the tongue plate insertion port 10. The hook member 6 is a member which swings downward (in the clockwise direction in FIG. 2) from the state shown in FIG. 2 and engages with the engaging hole 16 of the tongue plate 12. In this engaged state, the lock bar 7 is intended to restrict upward swinging of the hook member 6.

More specifically, as shown in FIG. 4, the frame 3 has a bottom wall 31 forming a wall surface (tongue sliding surface) continuous with the tongue plate guide portion 23 of the cover 2 (see also FIG. 2 for the continuous wall surface), and a pair of side walls 32 standing from both left and right end portions of the bottom wall 31. The frame 3 has a U-shaped cross section.

Figure 6A:
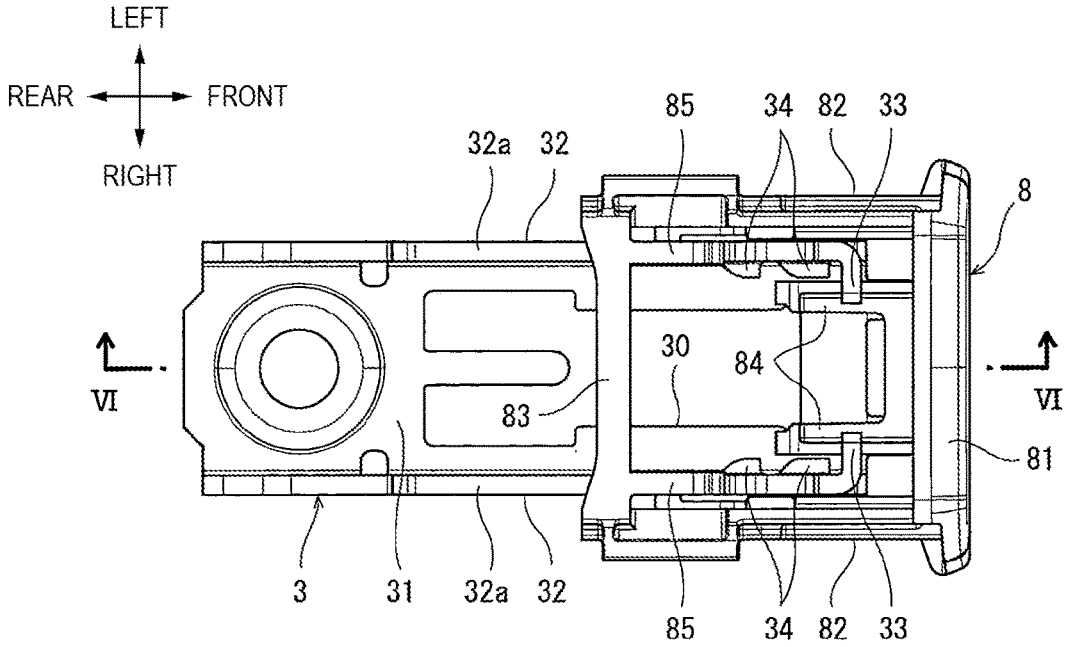
FIG. 6A is a plan view of only the frame and the release button.

A retaining hole 30 extending in a front and rear direction is formed in the bottom wall 31 (See FIG. 6A). The ejector 4 is disposed in the retaining hole 30. The ejector 4 is biased forward by a spring 51.

As shown in FIG. 4, a pair of left and right pressing portions 41 protruding upward is provided on the ejector 4. As shown in FIG. 1 (in a state where the buckle main body 11 is not engaged with the tongue plate 12 (non-engagement state)), these pressing portions 41 press leading ends of extending portions 84 of the release button 8 (to be described later) by a biasing force of the spring 51 (see also the hidden line in FIG. 2).

A protruding portion 33 protruding inward is provided at an end portion of each side wall 32 on the side of the tongue plate insertion port 10. When viewed from an upper and lower direction as shown in FIG. 1, the protruding portion 33 protrudes so as to overlap with the tongue plate 12 inserted from the tongue plate insertion port 10. That is, the distance between the protruding portions 33 is smaller than the width of the insertion part 15 of the tongue plate 12.

Further, two guide portions 34 arranged in the front and rear direction are provided on the rear side of the protruding portion 33 on each side wall 32. When viewed from the upper and lower direction as shown in FIG. 1, the guide portions 34 protrude inward from the side wall 32 so as to overlap with the tongue plate 12 inserted from the tongue plate insertion port 10. That is, the distance between the guide portions 34 is smaller than the width of the insertion part 15 of the tongue plate 12.

The guide portions 34 directly contact the tongue plate 12 and guide the tongue plate 12. The protruding portion 33 is located above the guide portion 34 and guides the tongue plate 12 via the extending portions 84 of the release button 8 (to be described later).

Furthermore, a first slit 35 and a second slit 36 arranged in the upper and lower direction are formed on a front side from the center on each side wall 32. A support hole 37 is formed on a rear side from the center on each side wall 32.

The hook member 6 includes a base portion 61 extending in the front and rear direction, a hook portion 62 hanging down from a front end portion of the base portion 61, a pair of left and right leg portions 63 hanging down from a rear end portion of the base portion 61, a pair of fulcrum portions 65 protruding to the left and right from the rear end portion of the base portion 61, and a rear surface portion 64 standing from the rear end portion of the base portion 61. Further, as the fulcrum portions 65 are inserted into the support holes 37 formed in the side walls 32 of the frame 3, the hook member 6 can swing around the fulcrum portions 65 as a fulcrum. Further, a restriction portion 66 protruding upward is provided slightly forward from the center of the base portion 61.

The lock bar 7 is disposed above the base portion 61 of the hook member 6. In the present embodiment, the lock bar 7 is divided into a first member 71 having a through-hole extending in a left and right direction and a rod-shaped second member 72 inserted into the through-hole. The first member 71 is made of a resin, and the second member 72 is made of a metal. However, the lock bar 7 may be a single member.

Both end portions of the second member 72 are inserted into the second slits 36 of the frame 3 so as to penetrate the side walls 32. In this manner, the lock bar 7 can be slid in the front and rear direction in the second slit 36 between a rear standby position where the buckle main body 11 is not engaged with the tongue plate 12 (non-engagement state) and a front locked position where the buckle main body 11 is engaged with the tongue plate 12 (engagement state).

A spring 52 is disposed between the first member 71 of the lock bar 7 and the rear surface portion 64 of the hook member 6. The spring 52 urges the hook member 6 so as to swing upward (so as to move the hook portion 62 upward), and urges the lock bar 7 forward. When the hook member 6 is swung upward, the lock bar 7 is restrained at the standby position by the restriction portion 66 of the hook member 6.

Figure 5A:
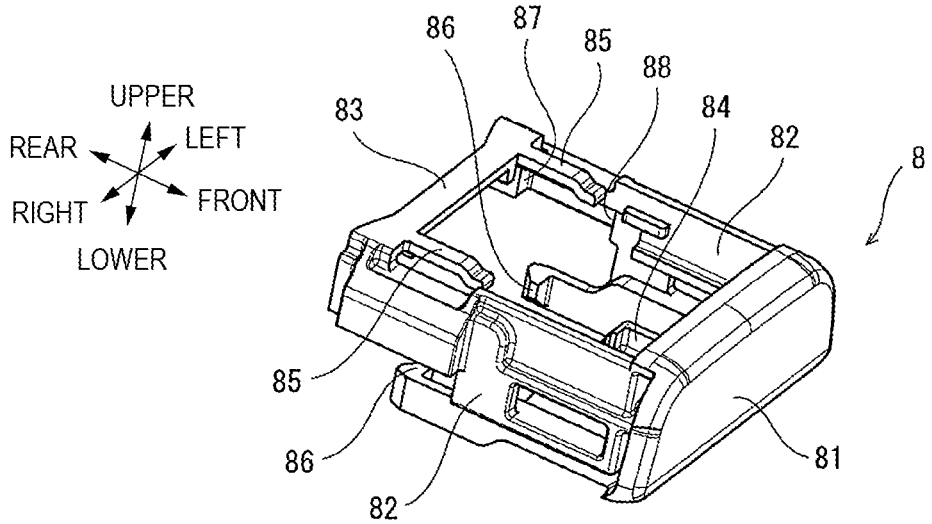
FIG. 5A is a perspective view of a release button as seen from above on the front side.
Figure 5B:
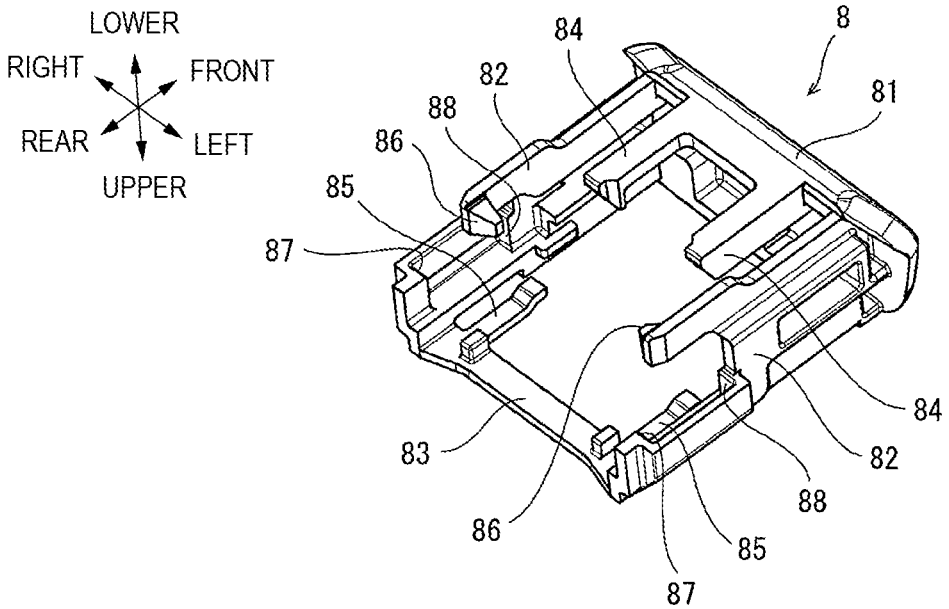
FIG. 5B is a perspective view of the release button as seen from below on the rear side.

As shown in FIGS. 5A and 5B, the above-described release button 8 has a front wall 81 elongated in the left and right direction, and a pair of side walls 82 extending rearward from both left and right end portions of the front wall 81. Both of the side walls 82 of the release button 8 are located outside the side walls 32 of the frame 3 (see FIG. 6A).

A claw 86 protruding inward is provided on each of the side walls 82 of the release button 8. As these claws 86 are inserted into the first slits 35 of the side walls 32 of the frame 3, the release button 8 is supported so as to be slidable in the front and rear direction. Further, rear end portions of the side walls 82 of the release button 8 are connected to each other by a bridging portion 83.

Furthermore, a first positioning portion 87 and a second positioning portion 88 are provided on each of the side walls 82 so as to sandwich end portions of the second member 72 of the lock bar 7 penetrating the side walls 32 from the front and rear direction. When the buckle main body 11 is not engaged with the tongue plate 12 (non-engagement state), the release button 8 is biased forward by the spring 51 via the ejector 4. In this way, the first positioning portions 87 abut against the end portions of the second member 72 of the lock bar 7 located at the standby position from the rear side, whereby the release button 8 is held in the normal position (position shown in FIG. 2) in the non-engagement state. When the buckle main body 11 is engaged with the tongue plate 12 engagement state), the end portions of the second member 72 of the lock bar 7 located at the locked position in a state of being biased forward by the spring 52 abut against the second positioning portion 88, whereby the release button 8 is held in the normal position in the engagement state.

The pair of left and right extending portions 84 extends rearward from a lower end portion of the front wall 81 of the release button 8 through the space between the protruding portions 33 of the frame 3 and the bottom wall 31. A tongue plate insertion space continuous with the tongue plate insertion port 10 is formed between the extending portions 84 and the bottom wall 31.

Figure 6B:
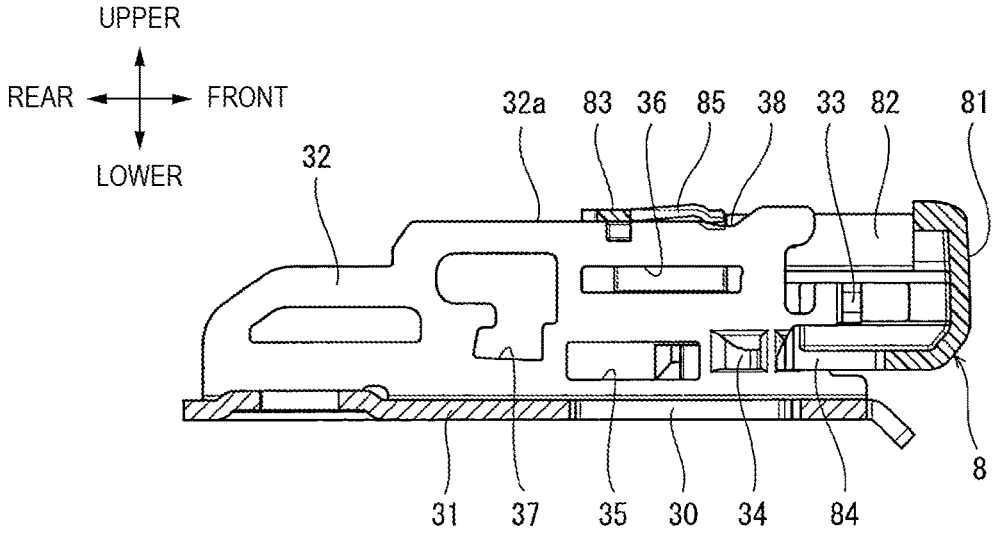
FIG. 6B is a sectional view taken along the line VI-VI in FIG. 6A.

Furthermore, as shown in FIGS. 5A and 5B, a pair of left and right spring pieces 85 is integrally formed in the release button 8. These spring pieces 85 press upper end surfaces 32*a* of the side walls 32 of the frame 3 so as to bring the extending portions 84 of the release button 8 into contact with the protruding portions 33, as shown in FIG. 6B. In the present embodiment, the spring pieces 85 extend forward from the bridging portion 83. However, the spring pieces 85 may be provided on the side wall 82.

A groove 38 is provided in the upper end surface 32*a* of each side wall 32 of the frame 3. Leading end portions of the spring pieces 85 are fitted to the grooves 38. As the leading end portions of the spring pieces 85 are fitted to the grooves 38, the release button 8 can be held in the normal portion in the non-engagement state only by the biasing force of the spring pieces 85.

Next, the operation of the buckle main body 11 will be described with reference to FIGS. 7A to 7C. The cover 2 is omitted in FIGS. 7A to 7C from the viewpoint of easiness of understanding.

Figure 7A:
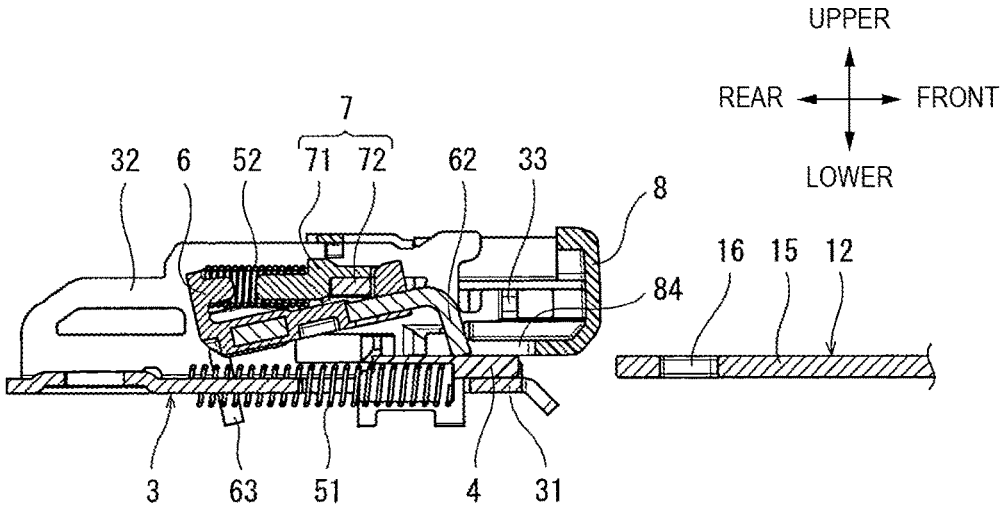
FIGS. 7A to 7C are views showing an operation of a buckle main body.

As shown in FIG. 7A, the hook member 6 is in a state of being swung upward before the tongue plate 12 is inserted into the tongue plate insertion port 10 (omitted in FIG. 7A). Therefore, the lock bar 7 is constrained in the standby position. Further, as the release button 8 is biased forward by the spring 51 via the ejector 4, the first positioning portions 87 of the release button 8 abut against both end portions of the second member 72 of the lock bar 7 from the rear side. In other words, the release button 8 is held in the normal position in the non-engagement state by the biasing force of the spring 51.

Figure 7B:
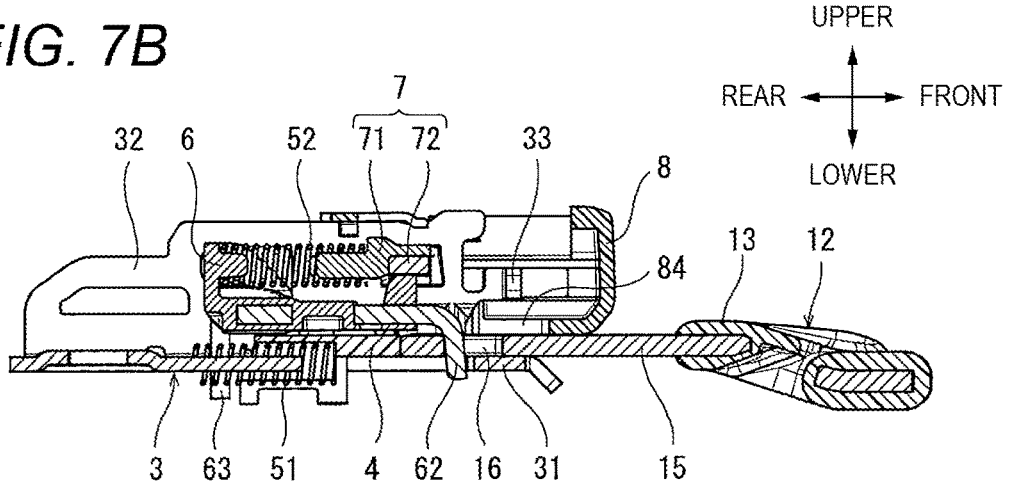

As shown in FIG. 7B, when the tongue plate 12 is inserted into the tongue plate insertion port 10, the ejector 4 is pushed by the tongue plate 12 and moves rearward to push the leg portions 63 of the hook member 6. In this way, the hook member 6 is swung downward, and the hook portion 62 is engaged with the engaging hole 16 of the tongue plate 12. Further, as the hook member 6 is swung downward, the restraint of the lock bar 7 by the restriction portion 66 is released and the lock bar 7 is moved to the locked position. In this way, both end portions of the second member 72 of the lock bar 7 abut against the second positioning portions 88 of the release button 8, and the release button 8 is held in the normal position in the engagement state by the biasing force of the spring 52. Further, the upward swinging of the hook member 6 is restricted by the lock bar 7 moved to the locked position.

The biasing force of the springs 51, 52 does not act on the release button 8 until the engagement of the hook member 6 is completed after the ejector 4 starts to move. However, as the leading end portions of the spring pieces 85 are fitted to the grooves 38 provided in the side walls 32 of the frame 3, the release button 8 can be held in the normal portion in the non-engagement state only by the biasing force of the spring pieces 85.

Figure 7C:
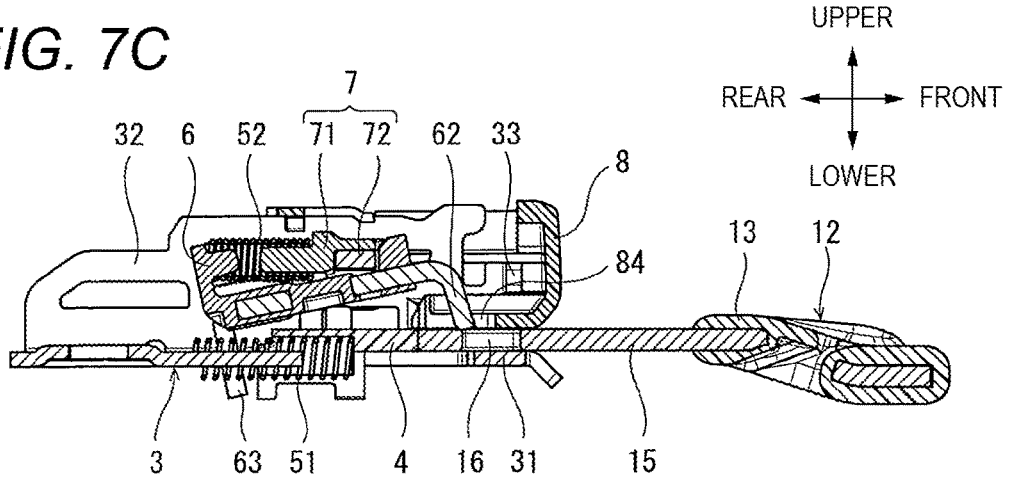
Figure 8:
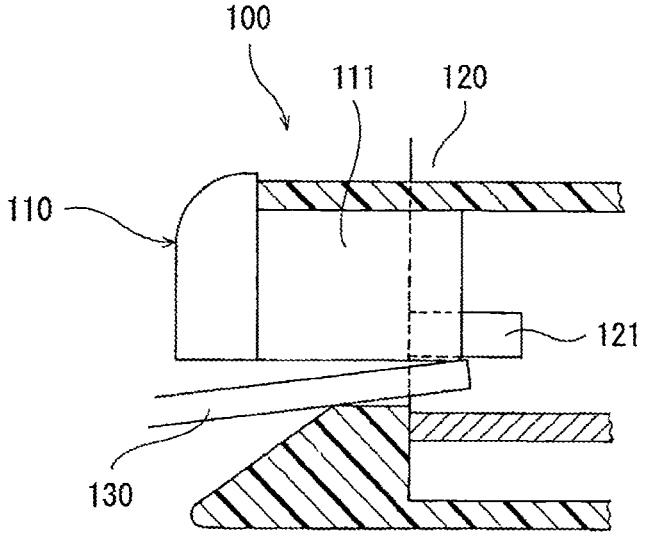
FIG. 8 is a partial sectional view of a conventional buckle device.

As shown in FIG. 7C, in order to pull out the tongue plate 12 from the buckle main body 11, the release button 8 is pushed against the biasing force of the spring 52. In this way, the lock bar 7 is moved to the standby position while being pushed by the second positioning portions 88 of the release button 8, and the restriction of the upward swinging of the hook member 6 by the lock bar 7 is released. As a result, the hook member 6 is swung upward, so that the engagement between the hook portion 62 and the engaging hole 16 of the tongue plate 12 is released. The biasing force of the spring 51 allows the ejector 4 to move forward until the pressing portions 41 of the ejector 4 abut against the leading ends of the extending portions 84 of the release button 8, thereby pushing out the tongue plate 12.

As explained above, in the buckle device 1 of the present embodiment, the extending portions 84 of the release button 8 made of a resin are interposed between the tongue plate 12 and the protruding portions 33 (parts of the frame 3) positioned in the vicinity of the tongue plate insertion port 10 when the tongue plate 12 is inserted from the tongue plate insertion port 10. Therefore, as shown in FIG. 2, when the tongue plate 12 is inserted into the tongue plate insertion port 10 in a state of being obliquely inclined, the extending portions 84 can prevent the tongue plate 12 from colliding with the protruding portions 33. Further, even when the extending portions 84 receive a load in an oblique direction from the tongue plate 12, the load is received by the protruding portions 33 of the frame 3 which are strength members. Thus, there is no need to make the extending portions 84 high in strength, and the release button 8 can be manufactured at low cost.

Further, in the present embodiment, the spring pieces 85 of the release button 8 maintain a state in which the extending portions 84 are abutted against the protruding portions 33 of the frame 3. Therefore, it is possible to prevent abnormal noise due to vibration during the driving of a vehicle.

(Modified Example) The disclosure is not limited to the above-described embodiments, and various modifications can be made without departing from the spirit of the disclosure.

For example, instead of the pair of extending portions 84, a single wide extending portion 84 may be provided in the release button 8.

The disclosure provides illustrative, non-limiting examples as follows:

An aspect of the present disclosure is a buckle device including: a tongue plate slidably provided along a longitudinal direction of a webbing; and a buckle main body configured to be engaged with the tongue plate, the buckle main body including: a cover having a tongue plate guide portion; a resin release button forming a tongue plate insertion port with the tongue plate guide portion; and a frame configured to slidably support the release button and having a bottom wall and a pair of side walls, wherein protruding portions protruding inward so as to overlap with the tongue plate inserted from the tongue plate insertion port are provided on end portions of the pair of side walls of the frame on the side of the tongue plate insertion port, respectively and wherein the release button has a front wall and at least one extending portion extending from the front wall through a space between the protruding portions and the bottom wall.

According to the above configuration, the extending portion of the release button made of a resin is interposed between the tongue plate and the protruding portions (parts of the frame) positioned in the vicinity of the tongue plate insertion port when the tongue plate is inserted from the tongue plate insertion port. Therefore, when the tongue plate is inserted into the tongue plate insertion port in a state of being obliquely inclined, the extending portion can prevent the tongue plate from colliding with the protruding portions. Further, even when the extending portion receives a load in an oblique direction from the tongue plate, the load is received by the protruding portions of the frame which are strength members. Thus, there is no need to make the extending portion high in strength, and the release button can be manufactured at low cost.

The release button may have a pair of spring pieces which presses upper end surfaces of the pair of side walls so as to bring the at least one extending portion to abut against the protruding portions. According to this configuration, since the state in which the extending portion of the release button is abutted against the protruding portions of the frame can be maintained, it is possible to prevent abnormal noise due to vibration during the driving of a vehicle.

For example, the buckle main body may include an ejector configured to be abutted against the tongue plate inserted from the tongue plate insertion port, and the ejector may press an upper end portion of the at least one extending portion when the buckle main body and the tongue plate are not engaged.

A tongue plate insertion space continuous with the tongue plate insertion port is formed between the at least one extending portion and the bottom wall.

According to the disclosure, it is possible to prevent the collision between the tongue plate and the frame when the tongue plate is inserted into the tongue plate insertion port in a state of being obliquely inclined.

What is claimed is:

1. A buckle device comprising:

a tongue plate slidably provided along a longitudinal direction of a webbing; and a buckle main body configured to be engaged with the tongue plate, the buckle main body including:

a cover having a tongue plate guide portion;

a resin release button forming a tongue plate insertion port with the tongue plate guide portion; and a frame configured to slidably support the release button and having a bottom wall and a pair of side walls, wherein protruding portions protruding inward so as to overlap with the tongue plate inserted from the tongue plate insertion port are provided on front faces ofend portions of the pair of side walls of the frame on the side of the tongue plate insertion port, respectively, and wherein the release button has a front wall and at least one extending portion extending from the front wall through a space between the protruding portions and the bottom wall, the at least one extending portion contacting the protruding portions.

2. The buckle device according to claim 1, wherein the release button has a pair of spring pieces which presses upper end surfaces of the pair of side walls so as to bring the at least one extending portion to abut against the protruding portions.

3. The buckle device according to claim 1, wherein the buckle main body includes an ejector configured to be abutted against the tongue plate inserted from the tongue plate insertion port, the ejector pressing an end portion of the at least one extending portion when the buckle main body and the tongue plate are not engaged.

4. The buckle device according to claim 1, wherein a tongue plate insertion space continuous with the tongue plate insertion port is formed between the at least one extending portion and the bottom wall.

5. A buckle device comprising:

a tongue plate slidably provided along a longitudinal direction of a webbing; and a buckle main body configured to be engaged with the tongue plate, the buckle main body including:

a cover having a tongue plate guide portion;

a resin release button forming a tongue plate insertion port with the tongue plate guide portion; and a frame configured to slidably support the release button and having a bottom wall and a pair of side walls, wherein protruding portions protruding inward so as to overlap with the tongue plate inserted from the tongue plate insertion port are provided on end portions of the pair of side walls of the frame on the side of the tongue plate insertion port, respectively, wherein the release button has a front wall and at least one extending portion extending from the front wall through a space between the protruding portions and the bottom wall, and wherein the release button has a pair of spring pieces which presses upper end surfaces of the pair of side walls so as to bring the at least one extending portion to abut against the protruding portions.

6. A buckle device comprising:

a tongue plate slidably provided along a longitudinal direction of a webbing; and a buckle main body configured to be engaged with the tongue plate, the buckle main body including:

a cover having a tongue plate guide portion;

a resin release button forming a tongue plate insertion port with the tongue plate guide portion; and a frame configured to slidably support the release button and having a bottom wall and a pair of side walls, wherein protruding portions protruding inward so as to overlap with the tongue plate inserted from the tongue plate insertion port are provided on end portions of the pair of side walls of the frame on the side of the tongue plate insertion port, respectively, wherein the release button has a front wall and at least one extending portion extending from the front wall through a space between the protruding portions and the bottom wall, and wherein the buckle main body includes an ejector configured to be abutted against the tongue plate inserted from the tongue plate insertion port, the ejector pressing an end portion of the at least one extending portion when the buckle main body and the tongue plate are not engaged.

* * * * *